United States Patent [19]

Thomson

[11] 4,179,344

[45] Dec. 18, 1979

[54] GOLD ALLOY PLATING COMPOSITIONS AND METHOD

[75] Inventor: Donald W. Thomson, East Northport, N.Y.

[73] Assignee: Lea-Ronal, Inc., Freeport, N.Y.

[21] Appl. No.: 649,321

[22] Filed: Jan. 15, 1976

Related U.S. Application Data

[63] Continuation of Ser. No. 375,370, Jul. 2, 1973, abandoned.

[51] Int. Cl.[2] ..... C25D 3/62

[52] U.S. Cl. ..... 204/44

[58] Field of Search ..... 204/44, 123

[56] References Cited

U.S. PATENT DOCUMENTS

| | | | |
|---|---|---|---|
| 3,056,733 | 10/1962 | Heilmann | 204/44 |
| 3,084,111 | 4/1963 | Strauss et al. | 204/51 |
| 3,586,611 | 6/1971 | Heilmann | 204/44 |
| 3,672,969 | 6/1972 | Nobel et al. | 204/43 G |

FOREIGN PATENT DOCUMENTS

| | | | |
|---|---|---|---|
| 651976 | 12/1964 | Belgium | 204/44 |
| 39-15406 | 8/1964 | Japan | 204/44 |

*Primary Examiner*—G. L. Kaplan

*Attorney, Agent, or Firm*—Pennie & Edmonds

[57] ABSTRACT

Gold base alloys containing copper and cadmium are deposited from aqueous plating baths comprising an aqueous alkaline bath containing soluble gold and copper cyanide compounds, a cadmium compound, free cyanide, and an effective amount of a chelating agent capable of chelating cadmium in the presence of free cyanide. The aqueous plating baths can also advantageously contain water soluble polyoxyalkylene compounds that act as brighteners in the above gold-copper-cadmium plating baths. The water soluble polyoxyalkylene compounds also act as brighteners in the gold-copper-cadmium baths in the absence of a chelating agent.

8 Claims, No Drawings

GOLD ALLOY PLATING COMPOSITIONS AND METHOD

This is a continuation of application Ser. No. 375,370 filed July 2, 1973 and now abandoned.

DESCRIPTION OF THE PRIOR ART

Many attempts have been made to produce thick layers of gold alloy electrodeposits, particularly with copper and cadmium, which would be ductile, of acceptable or superior brightness and luster and of low carat (about 14–19 carats).

One such attempt was to use selenium in the form of a water soluble selenium salt for gold alloy plating. Japanese Patent Application No. 15406 of Aug. 3, 1964 discloses the use of gold plating baths containing potassium metal cyanide complexes of gold, copper and cadmium and selenite salt such as sodium selenite. However, as indicated in Japanese Patent Application Publication No. 19046 of Nov. 4, 1966, although a selenite salt is a good additive for use as a lusterizing agent in copper-cadmium-gold alloy electrolytes, when the copper concentration in the electrolyte is high, the lusterizing agent loses effect and causes clouding instead.

Both Japanese Patent Application Publications disclose the use of cadmium as potassium cadmium cyanide salts in amounts ranging from 0.1–0.5 g/l with the preferred usage level being 0.2 g/l. It is necessary that the cadmium metal concentration be kept at this low level in order to obtain an alloy having acceptable physical and mechanical characteristics. If the cadmium metal concentration were to exceed about 0.5 g/l, the plating would tend to become brittle and of a color that is not commercially desirable. Furthermore, during the plating process, the cadmium concentration decreases rapidly and in order to maintain the required alloy concentration throughout the duration of the plating process, it becomes necessary to add additional amounts of the cadmium salt very frequently to maintain a sufficient cadmium concentration.

U.S. Pat. No. 2,056,733, Oct. 2, 1962, refers to the use of periodic reverse current to obtain bright deposits. U.S. Pat. No. 3,586,611 points out the disadvantages of the use of periodic reverse current, noting that the bright current density range is relatively small and that the coatings are of a reddish color which sometimes is not desirable, and in addition, roughness of the coatings whith heavier thicknesses result. In order to overcome these disadvantages, U.S. Pat. No. 3,586,611 suggests the use of small amounts of silver in the plating bath to act as a brightener and grain refiner. Silver, however, has been shown to impair the ductility of the deposit and make the color of the deposit most difficult to control.

U.S. Pat. No. 2,724,687 of Nov. 22, 1955 relates to gold plating baths where the gold is present as the cyanide and all of the alloy metals are present as EDTA chelates. The bath of this U.S. patent must also be free of any other cyanides, including free cyanide and employs divalent copper. As will be apparent from the following disclosure, one of the inventive factors of this invention is that the gold and copper must be present as cyanides, free cyanide is present, and the cadmium compound contained therein is in the presence of a chelating agent capable of forming a chelate with the cadmium in the presence of free cyanide. In the bath and process of the invention, the copper is present in the monovalent state. The process of U.S. Pat. No. 2,724,687 cannot be used to obtain acceptable low carat gold-copper-cadmium alloys. The coatings have poor ductility and are brittle in heavy thicknesses and the color is poor.

SUMMARY OF THE INVENTION

This invention relates to a process and bath which produces heavy or thick, ductile, bright deposits of gold-copper-cadmium alloys of low carat which comprises adding to the gold alloy bath an effective amount of a chelating agent capable of chelating the cadmium in the presence of free cyanide.

Particularly bright gold-copper-cadmium alloys are produced according to this invention by adding to the bath containing a cadmium chelating agent, a polyoxyalkylene compound, in which the alkylene moiety contains 1 to 3 carbon atoms, such as methylene, ethylene or propylene that act as brighteners. The invention also includes the use of the polyoxyalkylene compounds which act as brighteners in the gold-copper-cadmium baths in the absence of a cadmium chelating agent.

The use of the chelating agents advantageously permit the use of copper and cadmium concentration in a much higher concentration and obtaining a deposit of uniform consistant color and carat without difficulty than theretofore possible. The soluble copper cyanide salt can be present in any amount up to the limit of its solubility. Since the copper concentration may be increased over that attainable with prior art baths, this is one reason why an acceptable gold alloy plating of lower carat can be obtained. And since the cadmium concentration may be increased at least twenty times the highest amount disclosed in the Japanese patents referred to above, the baths, according to this invention, eliminate the need for very frequent replenishment of cadmium.

Low carat gold alloy platings having a thickness of at least about 20 to 40 microns or about 0.00075 to 0.0015 inches can be produced according to the invention while remaining ductile and also having exceptional brightness. Although the invention can produce low carat bright heavy coating, thinner coatings can also be advantageously produced, if desired.

DESCRIPTION OF THE PREFERRED EMBODIMENTS

According to this invention, electrodeposition of gold alloys is carried out from an alkaline aqueous plating bath containing at least one soluble gold cyanide salt, a soluble copper cyanide salt, free cyanide, and a cadmium compound in which there is dissolved an effective amount of a chelating agent capable of chelating the cadmium in the presence of free cyanide.

Particularly bright gold-copper-cadmium alloys are produced according to this invention by adding to the bath polyoxyalkylene compounds that act as brighteners for the gold alloy. The invention also includes the use of such polyoxyalkylene compounds which act as brighteners in the gold-copper-cadmium baths in the absence of a chelating agent. It is of course advantageous to utilize the polyoxyalkylene compounds in combination with the cadmium chelating agent to obtain leveled and consistent uniformity of color in the resulting deposit. From the work done so far, it has also been found that the polyoxyalkylene compounds only act as brightening agents in gold cyanide baths in combination with cadmium in the cyanide or chelate form.

The polyoxyalkylene compounds also significantly improve the leveling of the deposits.

Examples of chelating agents that can be used according to this invention include organo-phosphorus compounds, such as monoamine phosphonic acids and their corresponding soluble salts conforming to the structural formula:

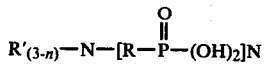

wherein R is a lower alkylidene radical and its water soluble salts, R′ is hydrogen or a lower alkyl radical and n is an integer from 1 to 3.

Some more specific examples of phosphonic acids chelating agents coming within the above formula include those having structural formulas corresponding to:

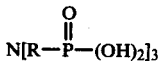

(a)

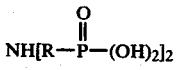

(b)

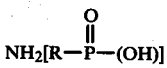

(c)

wherein R has the same meaning as defined above or contains 1 to 5 carbon atoms.

Further examples of chelating organo-phosphorus compounds which can be used according to this invention include 1-hydroxyethylidene-1, 1 diphosphonic acid

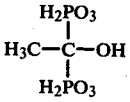

ethylenediaminetetra (methylphosphonic) acid

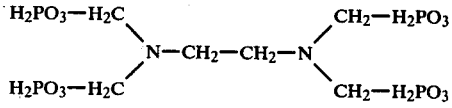

hexamethylenediaminetetra (methylphosphonic) acid

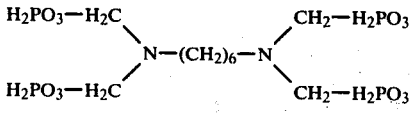

hexamethylphosphonic triamide $[(CH_3)_2N]_3PO$ and the compound

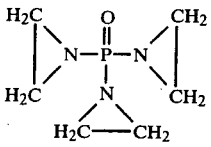

Amine carboxy acid or amine polycarboxy acid chelating agents that can be used according to this invention include various derivatives of the amine carboxy acids and include alkylenepolyacetic acids and particularly alkylenepolyaminepolyaceticacids, nitrilo triacetic acid and their soluble salts, such as ethylenediaminetetracetic acid (EDTA) and diethylenetriaminepentacetic acid (DTPA).

Other chelating agents capable of effectively chelating the cadmium in the presence of free cyanide can be used as will be apparent to those skilled in the art.

The chelating agents can be employed in the gold alloy baths directly as the acid or in the form of salts. The chelating agents are generally added in the acid form in which case they form salts after being placed in solution. When the acids are added, the salt that forms will depend on the particular bath being employed. When the chelating agents are added to the bath directly as a salt, such as the disodium salt of EDTA the effective proportions will vary and will generally be higher to accomplish the same objections as would be required when the acid form is added to the baths.

The exact mechanism which results in the improvement of this invention is not completely understood. The chelating agents appear to have a strong chelating effect on the cadmium even though there is a large concentration of free cyanide in the bath. The gold and copper cyanide complexes which are also present in the bath remain in the form of their electrodepositable cyanide complexes. Due to the strong chelating effect on cadmium, electrodeposition may be carried out with much higher cadmium or copper concentrations.

It is believed that the cadmium is present in the bath during the plating operation as the cadmium chelate, or predominately the cadmium chelate of the chelating agent employed, the important factor being the presence of a chelating agent in the bath together with gold cyanide, copper cyanide, a cadmium compound, and free cyanide. When the cadmium chelate is first prepared as a chelate as in Example I it is believed that the cadmium remains in the chelate form during the deposition. When the cadmium is added as a salt, such as cadmium sulfate as in Example IV, and the chelating agent later added, it is believed that the cadmium converts to the corresponding chelate and the plating of the gold-copper-cadmium alloy is accomplished therefrom.

The amount of free cyanide has been found to generally range between 25 and 35 grams per liter but can be either above or below this range. The higher the free cyanide content, the higher the carat of the plating since the presence of free cyanide generally inhibits the deposition of copper.

The cadmium concentration depends in turn upon the concentration and chelating ability of the chelating agent and can vary quite widely. For example, when the chelating agent is ethylenediamine tetramethylphosphonic acid at a concentration of about 15 g/l, a plating bath composition containing about 12 g/l potassium cadmium cyanide is advantageous. Thus generally as the amount of chelating agent dissolved in the bath increases, the amount of cadmium which should be present also increases. The cadmium concentration can also be advantageously reduced to provide pink-colored alloys which are high in copper content.

The exact amounts of chelating agents that can be used is not critical, and will vary depending on the particular chelating agent employed in the baths and the optimum amounts for any particular chelating agent or bath can be determined by routine experimentation.

The polyoxyalkylene compounds referred to above are polyoxyalkylene compounds in which the alkylene moiety contains 1 to 3 carbon atoms, such as methylene, ethylene and propylene. The polyoxyalkylene compounds that can be used as brightening agents according to this invention are the well-known groups of compounds, many of which correspond to the general formula:

(a) $R\text{-}O\text{-}(C_nH_{2n}O)_xH$ wherein R is hydrogen, or an alkyl or aryl group or combinations of alkyl and aryl such as nonyl phenyl, n is 1, 2 or 3 and x is advantageously a number between about 5 and 20. When R is an alkyl group it preferably contains between about 1 to 20 carbon atoms. When R contain an aryl group it preferably is phenyl, but other aryl groups can be substituted therefor as will be apparent to those skilled in the art, especially since this is a well-known group of compounds.

Other polyoxyalkylene compounds that can be used according to this invention include

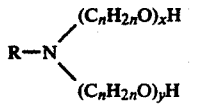
(b)

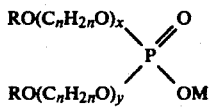
(c)

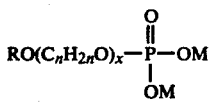

where M is hydrogen, an alkali metal, such as sodium, potassium, etc., ammonium or an amine.

(d) $R\text{-}S\text{-}(C_nH_{2n}O)_xH$

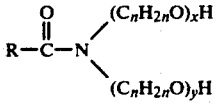
(e)

(f) $N\text{-}[C_2H_4O(C_nH_{2n}O)_xH]_3$

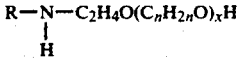
(g)

(h) water soluble polymers of 1.3 dioxolane

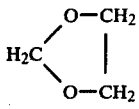

(i) $H(C_nH_{2n}O)_y\text{-}NH(C_2H_4NH)_a\text{-}(C_nH_{2n}O)_xH$

In the above formulas, R, n and x have the same meaning as defined above. y can be the same as x. x and y can be different numbers and x+y is advantageously a number between 5 and 20.

The numerical designations for x and y and for the number of carbon atoms in the R group are not limited but are given above as being advantageous and by way of examples only since x and/or y, will depend on the numerical designation given to n as well as the number of carbon atoms in the R group and vice versa. Definite values can thus not be assigned to the x, y and R designations in the above formulas as a practical matter. The determining factor is the water solubility of the polyoxyalkylene compounds and the total molecular weight, (which includes the numerical designations of the carbon atoms in the R group, x, y and n) which should be sufficiently low to impart or maintain the water solubility of the polyoxyalkylene compounds. Water solubility means either true or colloidal solubility in distinction to a typical water-oil separation. Some insolubility can occur in the bath resulting in turbidity or a water-oil type separation, but this does not appear to interfere with the action of the polyoxyalkylene compounds as brightening agents so long as a sufficient amount of the polyoxyalkylene compound is soluble in the aqueous bath being used.

Some examples of specific compounds coming within the above formulas and which can advantageously be used as brightening agents include

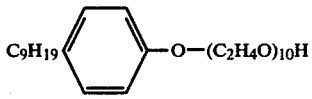
(a-1)

(a-2) $HOCH_2(CH_2CH_2O)_{10}CH_2OH$

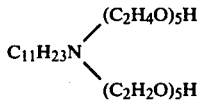
(b-1)

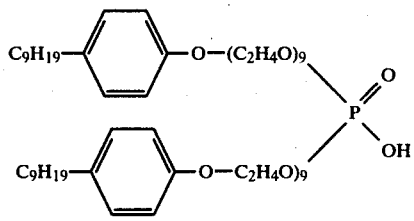
(c-1)

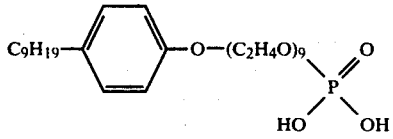
(c-2)

(d-1) $C_{12}H_{25}\text{-}S\text{-}(C_2H_4O)_8H$

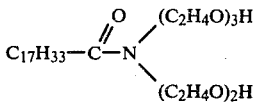

(e-1)

(f-1) $N\text{-}[C_2H_4O(C_2H_4O(C_2H_4O)_{10}H]_3$
(g-1) $C_{12}H_{25}\text{-}NH\text{-}C_2H_4O(C_2H_4O)_{10}H$
(h-1) $(CH_2\text{-}O\text{-}C_2H_4O)_{10}$
(i-1) $H(C_2H_4O)_y\text{-}NH(C_2H_4NH)_2\text{-}C_2H_4O)_xH$
where x+y equals 10.

The above polyoxyalkylene compounds can be substituted in well-known manners, e.g. the water soluble alkali metal salts such as Na thereof, the sulfates, sulfonates, etc.

Other polyoxyalkylene compounds can of course be used as brighteners according to this invention as will be apparent to those skilled in the art.

The amount of polyoxyalkylene compounds added to the bath is not critical. A sufficient amount should be added to achieve the desired brightening effect which amount will vary depending upon the particular polyoxyalkylene compound being used as will be apparent to those skilled in the art. For example, a higher amount of a lower molecular weight polyoxyalkylene is generally required than of a higher molecular weight polyoxyalkylene compound. Excess amounts of the polyoxyethylene compound over that which gives the desired brightening effect do not generally interfere with the plating operation and only add to this expense. Generally, about 0.1 g/l of a polyoxyalkylene compound having a molecular weight of about 400 to 500 will give an optimum brightening effect. When other polyoxyalkylene compounds are used, the optimum results can be readily determined by routine experimentation by those skilled in the art. Those polyoxyalkylene compounds having the properties of a wetting agent have been found to be most advantageous and therefore it is advantageous to use compounds in which the $-(C_nH_{2n}O)-$ moiety has a molecular weight between about 200 and 600 and preferably between 400 and 500.

The temperature of the bath may advantageously be held in the range of 120° and 160° F. Current density may advantageously be maintained at 3 to 12 asf (amperes per square foot). Although the pH of the bath may be varied, a pH of about 9.5 to 12.0 has been found to be advantageous. A pH of 10.5 has yielded optimum results in tests so far conducted. It is advantabeous to incorporate a buffer to maintain the pH at 10.5. The buffer may be potassium carbonate, potassium phosphate or any other known and conventional buffer for the pH range employed.

The following examples illustrate various specific manners by which the invention can be practiced:

EXAMPLE I

| | |
|---|---|
| Potassium Gold Cyanide | 7.5 g/l |
| Potassium Copper Cyanide | 200 g/l |
| Cadmium (as metal in form of ethylene diamine tetramethylphosphonate) | 0.7 g/l |
| Free KCN | 30 g/l |
| Total ethylene diamine tetramethyl phosphonic acid including that added as combined with cadmium | 2 g/l |

The pH of the solution was adjusted to about 10.5 with KOH and the gold alloy deposited by electrodeposition in the conventional manner on a brass panel at 6 asf (0.6 amp./dm$^2$) one hour while maintaining the bath at 140° F. and a semi-bright ductile alloy deposit of 19 carat is obtained.

EXAMPLE II

To Example I was added 0.1 g/l of the phosphate ester of a condensation product of nonyl phenol and ethylene oxide containing 10 moles of ethylene oxide. A brilliant highly leveled, ductile deposit was produced at a thickness of 20 microns of 19 carat. This example illustrates the brightening effect of the polyoxyalkylene compounds in the presence of cadmium.

EXAMPLE III

| | |
|---|---|
| Potassium Gold Cyanide | 7.5 g/l |
| Potassium Copper Cyanide | 200 g/l |
| Potassium Nitrilo Triacetic acid | 14 g/l |
| Free KCN | 25 g/l |
| A mixture of phosphate esters of a condensation product of nonyl phenol and ethylene oxide containing 9 moles of ethylene oxide in each oxyethylene chain (A mixture of the compounds of formulas (c-1) and (c-2) | 0.1 g/l |

Plating operations were conducted in the same manner as in Example I. The carat was about 16 and the deposit having a thickness of 20 microns was pink and dull. This Example illustrates the inactivity of the polyoxyalkylene compounds as brightening agents in gold-copper baths in the absence of cadmium. When cadmium is added as in Example IV, the polyoxyalkylene compounds act as excellent brightening agents.

EXAMPLE IV

| | |
|---|---|
| Potassium Gold Cyanide | 7.5 g/l |
| Potassium Copper Cyanide | 200 g/l |
| Cadmium added as metal in form of sulfate | 1 g/l |
| Potassium Nitrilo triacetic acid | 14 g/l |
| Free KCN | 25 g/l |
| A mixture of phosphate esters of the condensation product of nonly phenol and ethylene oxide containing 9 moles of ethylene oxide in each oxyethylene chain (a mixture of the compounds of formulas (c-1) and (c-2) | 0.1 g/l |

The alloy was deposited on a brass panel as described in Example I. The results were the same as in Example II, except the carat was 18.5.

EXAMPLE V

| | |
|---|---|
| Potassium Gold Cyanide | 8 g/l |
| Potassium Copper Cyanide | 210 g/l |
| Potassium Cadmium Cyanide | 0.5 g/l |
| Free KCN | 28 g/l |
| pH 10.0 | |

The alloy was deposited on a brass panel as in Example I except that the temperature of operation was 150°

F. and the current density 7 asf (0.7 amp./dm$^2$). A deposit of 20 microns was obtained which was dull. Obtaining a uniform consistant color and carat was difficult since frequent addition of cadmium is required. The deposit was 18 carat.

EXAMPLE VI

To Example V was added 0.1 g/l of polyoxyethylene glycol (M.W. 400). A bright deposit was obtained for the same thickness of deposit and carat, however, obtaining a uniform consistant color and carat was difficult as in Example V. This example illustrates the brightening action of the polyoxyalkylene compound in the presence of cadmium, but in the absence of the chelating agent.

EXAMPLE VII

In Example VI the potassium cadmium cyanide concentration was increased to 2.0 g/l and there was added 23.6 g/l of 1-hydroxy-ethylidene-1,1 diphosphonic acid as the sodium salt and the alloy deposited in the same manner as in Example VI. This gave brilliant, leveled, ductile 18 carat deposits with much more consistant uniformity than Example VI without difficulty in maintaining consistant color and carat.

EXAMPLE VIII

| | |
|---|---|
| Potassium Gold Cyanide | 8 g/l |
| Potassium Copper Cyanide | 250 g/l |
| Cadmium (added as a nitrate) | 1 g/l |
| Tetrasodium ethylene diamine tetra-acetate | 3 g/l |
| Potassium Carbonate | 20 g/l |
| Free KCN | 25 g/l |
| The condensation product of triethanolamine and ethylene oxide containing 30 moles of ethylene oxide (formula f-1) | 0.05 g/l |
| pH 11.0 | |

The alloy was deposited in the same manner as in Example I except that the current density was 9 asf (0.9 amp./dm$^2$). Brilliant, leveled, ductile deposits, pink in color and lower than 18 carat are obtained.

The metals added to the baths to produce the gold alloys according to this invention can be added in various forms so long as they are soluble in the baths and do not otherwise interfere with the production of the desired gold alloy plating as would be apparent to one skilled in the art. The cadmium, for example, can be added to the cyanide baths in the form of cadmium oxide, cadmium sulfate, cadmium carbonate, cadmium nitrate, or even in the form of the cadmium chelate.

Although the above examples relate to the deposition of an approximately 18 to 19 carat gold alloy, the carat can be considerably varied by changes in the portions or ratios of the metals added to form the gold alloy as will also be apparent to one skilled in the art. Gold alloys of lower carat or as high as about 22–23 carat can advantageously be deposited according to this invention.

The color of the particular alloy can also be varied by changes in the proportions or ratios of the alloy metals and/or other parameters, such as pH, amount of chelating agent, current density, etc., from pink to yellow as will be apparent to those skilled in the art.

A soluble selenium or tellurium salt can be added to the baths of this invention to reduce leveling of the deposits if this is desired. The amount of the selenium or tellurium salt used to accomplish this will depend on the salt used as well as the desired extent of leveling desired. For example, leveling can be considerably reduced by adding about 0.05 g/l of sodium selenite or 0.002 g/l of tellurium oxide ($TeO_2$). The addition of 0.002 g/l to 0.004 g/l of tellurium oxide to the bath of Example IV produced a deposit of like brilliance, but the leveling significantly reduced.

I claim:

1. An aqueous alkaline bath for direct current plating gold-copper-cadmium alloys comprising an alkaline aqueous bath containing a soluble gold cyanide, a soluble copper cyanide, free cyanide, and a cadmium compound in sufficient amount to plate gold-copper-cadmium alloys, and a chelating agent capable of chelating the cadmium in the presence of free cyanide in a sufficient amount to chelate the cadmium.

2. The bath of claim 1 in which the chelating agent is an organo phosphorus compound or an amine carboxy compound.

3. The bath of claim 2 which includes a water soluble polyoxyalkylene brightening agent in a sufficient amount to increase the brightness of an alloy electrodeposited therefrom.

4. The bath of claim 3 in which the brightening agent is a polyoxyalkylene wetting agent having a molecular weight between about 400 and 500.

5. The bath of claim 3 which contains a sufficient amount of a soluble selenium or tellurium compound to reduce the leveling of the deposits.

6. The bath of claim 1 which includes a water soluble polyoxyalkylene brightening agent in a sufficient amount to increase the brightness of an alloy electrodeposited therefrom.

7. The process of direct current plating or depositing of a gold-copper-cadmium alloy which comprises electrodepositing by direct current plating said alloy from an aqueous alkaline plating bath containing a soluble gold cyanide complex, a soluble copper cyanide complex, and a soluble cadmium compound in sufficient amount to plate gold-copper-cadmium alloys, free cyanide, and a chelating agent capable of chelating cadmium in the presence of the free cyanide in sufficient amount to chelate the cadmium.

8. An aqueous alkaline bath for direct current plating gold-copper-cadmium alloys comprising an alkaline aqueous bath containing a soluble gold cyanide, a soluble copper cyanide, free cyanide, and a cadmium compound in sufficient amount to supply in excess of about 0.5 g/l of cadmium metal in said bath, and a chelating agent capable of chelating the cadmium in the presence of free cyanide in a sufficient amount to chelate the cadmium.

* * * * *

UNITED STATES PATENT AND TRADEMARK OFFICE

CERTIFICATE OF CORRECTION

PATENT NO. : 4,179,344

DATED : December 18, 1979

INVENTOR(S) : Donald W. Thomson

It is certified that error appears in the above-identified patent and that said Letters Patent are hereby corrected as shown below:

Column 1, line 42, reads "2,056,733", should read --3,056,733--

Column 7, line 7, (f-1) reads "N-$[C_2H_4O(C_2H_4O(C_2H_4O)_{10}H]_3$" should read --N-$[C_2H_4O(C_2H_4O)_{10}H]_3$--

Signed and Sealed this

*Twenty-fifth* Day of *March 1980*

[SEAL]

*Attest:*

SIDNEY A. DIAMOND

*Attesting Officer*

*Commissioner of Patents and Trademarks*